US008522918B1

(12) United States Patent
Al-Wasis

(10) Patent No.: US 8,522,918 B1
(45) Date of Patent: Sep. 3, 2013

(54) RESCUE HARNESS

(71) Applicant: Adel Abdulmuhsen Al-Wasis, Sabahiya (KW)

(72) Inventor: Adel Abdulmuhsen Al-Wasis, Sabahiya (KW)

( * ) Notice: Subject to any disclaimer, the term of this patent is extended or adjusted under 35 U.S.C. 154(b) by 0 days.

(21) Appl. No.: 13/762,287

(22) Filed: Feb. 7, 2013

(51) Int. Cl.
*A62B 1/00* (2006.01)

(52) U.S. Cl.
USPC ..... 182/3; 182/193; 182/5

(58) Field of Classification Search
USPC ..... 182/193, 72, 5–7, 3, 70
See application file for complete search history.

(56) References Cited

U.S. PATENT DOCUMENTS

| | | | | | |
|---|---|---|---|---|---|
| 190,829 | A | * | 5/1877 | Costantino | 224/677 |
| 2,317,346 | A | * | 4/1943 | Reith | 182/4 |
| 2,574,178 | A | * | 11/1951 | Haller | 182/3 |
| 2,613,953 | A | * | 10/1952 | Giovannoni | 280/1.5 |
| 2,960,180 | A | * | 11/1960 | Wachtel | 182/3 |
| 3,006,431 | A | * | 10/1961 | Meyer | 182/5 |
| 3,415,340 | A | * | 12/1968 | Kinkade | 182/7 |
| 3,717,219 | A | * | 2/1973 | Hoffman | 182/6 |
| 3,869,021 | A | * | 3/1975 | Sutherland et al. | 182/3 |
| 4,056,166 | A | * | 11/1977 | Rabelos | 182/5 |
| 4,448,281 | A | * | 5/1984 | Adams | 182/5 |
| 4,550,801 | A | | 11/1985 | Forrest | |
| 4,560,029 | A | * | 12/1985 | Dalmaso | 182/5 |
| 4,694,934 | A | * | 9/1987 | Erickson | 182/142 |
| 4,714,135 | A | | 12/1987 | Bell et al. | |
| 4,768,619 | A | * | 9/1988 | Darnell | 182/129 |
| 5,657,543 | A | * | 8/1997 | Collins | 30/367 |
| 5,913,383 | A | * | 6/1999 | Tseng | 182/236 |
| 5,971,668 | A | * | 10/1999 | Miller | 405/259.1 |
| 6,095,502 | A | * | 8/2000 | Dodge, Jr. | 254/389 |
| 6,308,355 | B1 | * | 10/2001 | McMillan et al. | 7/142 |
| 6,405,440 | B1 | * | 6/2002 | Clark et al. | 30/164.9 |
| 6,481,528 | B2 | * | 11/2002 | Antonio | 182/6 |
| 6,817,443 | B1 | * | 11/2004 | Metz | 182/82 |
| 6,820,721 | B1 | * | 11/2004 | Henson | 182/5 |
| 7,055,653 | B2 | * | 6/2006 | Hamada | 182/231 |
| 2001/0047904 | A1 | * | 12/2001 | Antonio | 182/3 |
| 2002/0112916 | A1 | * | 8/2002 | Ador | 182/5 |
| 2003/0051944 | A1 | | 3/2003 | Shea | |
| 2004/0207534 | A1 | | 10/2004 | Bolta | |
| 2006/0070809 | A1 | * | 4/2006 | Barzilai | 182/193 |
| 2006/0175128 | A1 | | 8/2006 | Vonblon | |
| 2006/0195962 | A1 | | 9/2006 | Jordan | |
| 2008/0087498 | A1 | * | 4/2008 | Barzilai | 182/193 |
| 2008/0230313 | A1 | | 9/2008 | Botti | |
| 2009/0236177 | A1 | * | 9/2009 | Maurice et al. | 182/6 |
| 2010/0065373 | A1 | * | 3/2010 | Stone et al. | 182/233 |
| 2010/0282541 | A1 | * | 11/2010 | Renton et al. | 182/234 |
| 2013/0075195 | A1 | * | 3/2013 | Barzilai | 182/129 |

* cited by examiner

FOREIGN PATENT DOCUMENTS

WO WO 03/055560 7/2003

*Primary Examiner* — Alvin Chin Shue
*Assistant Examiner* — Daniel Cahn
(74) *Attorney, Agent, or Firm* — Richard C. Litman

(57) ABSTRACT

The rescue harness is a personal use device for donning by an individual requiring escape from an elevated location in a building structure or the like. The harness includes a front latch and bracket having a removable combination glass cutter and hammer, and a removable explosive charge. A rope brake is also secured to the bracket, and a rope passes through the brake. The user of the harness removes the glass cutter and hammer combination, and scribes an opening on a glass window panel. The explosive charge is placed on the glass in the scribed area. A timer permits the user to momentarily leave the immediate vicinity. The hammer is used to break out any remaining glass shards after the explosion blows out the scribed area of glass. The user exits the structure through the hole in the panel, using the rope brake to control his or her descent.

19 Claims, 6 Drawing Sheets

RESCUE HARNESS

BACKGROUND OF THE INVENTION

1. Field of the Invention

The present invention relates generally to emergency equipment and devices, and particularly to a rescue harness providing for the escape of an individual from a high-rise structure or the like.

2. Description of the Related Art

The extremely high cost of land in the centers of many large cities places a premium on the costs of building any form of structure in such areas. At the same time, technology has permitted the construction of ever taller buildings and structures for use as business or office buildings and living quarters (apartments and condominiums). As a result, increasingly taller building structures are being constructed in cities around the world.

A universal potential problem with such tall buildings is the emergency evacuation of people from such structures in the event of a fire or other emergency event. Generally, multiple elevators are provided in such tall structures, and alternative means of operating such elevators are also provided in the event of power outages on the local power grid. Nonetheless, the complete failure of elevator systems certainly occurs from time to time, even in such taller structures with various alternatives and backups. Stairways are universally provided in such structures for use when elevators are not functioning, but the evacuation of hundreds of people down dozens of flights of stairs is impracticable at best.

Accordingly, various personal rescue devices have been developed in the past. An example of such is found in PCT Patent Publication No. 03/055,560 published on Jul. 10, 2003 to Simon Suter, which publication describes (according to the drawings and English abstract) a personal rescue harness including a rope storage drum and automatic braking device to slow the deployment of the rope from the drum, thus slowing the descent of a person wearing the harness. Additional tools are also disclosed.

Thus, a rescue harness solving the aforementioned problems is desired.

SUMMARY OF THE INVENTION

The rescue harness includes an adjustable diameter waist belt having a sling seat therein and shoulder straps extending therefrom. The openable front of the belt includes a bracket or latch assembly having a rope brake and various tools attached thereto. A combination hammer and glass cutting blade is removably attached to the bracket assembly, and a rope or line passes through this combination component. A small removable explosive charge with a timer delay is also provided with the bracket assembly.

The harness is donned by an individual who needs to escape from a location well above ground level in a building structure or the like. The combination hammer and glass cutter are removed from the bracket, and the glass cutter is used to scribe a weakening or fracture line in a glass window panel. The explosive charge is then removed from the bracket and placed on the glass panel. The timer delay permits the user to remove himself or herself from the immediate location of the explosion. The hammer may then be used to break out any remaining shards of glass, if necessary. The end of the rope is secured to or passed around some secure object, and the harness wearer exits the structure through the previously formed hole in the glass panel, controlling his or her descent with the rope brake.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
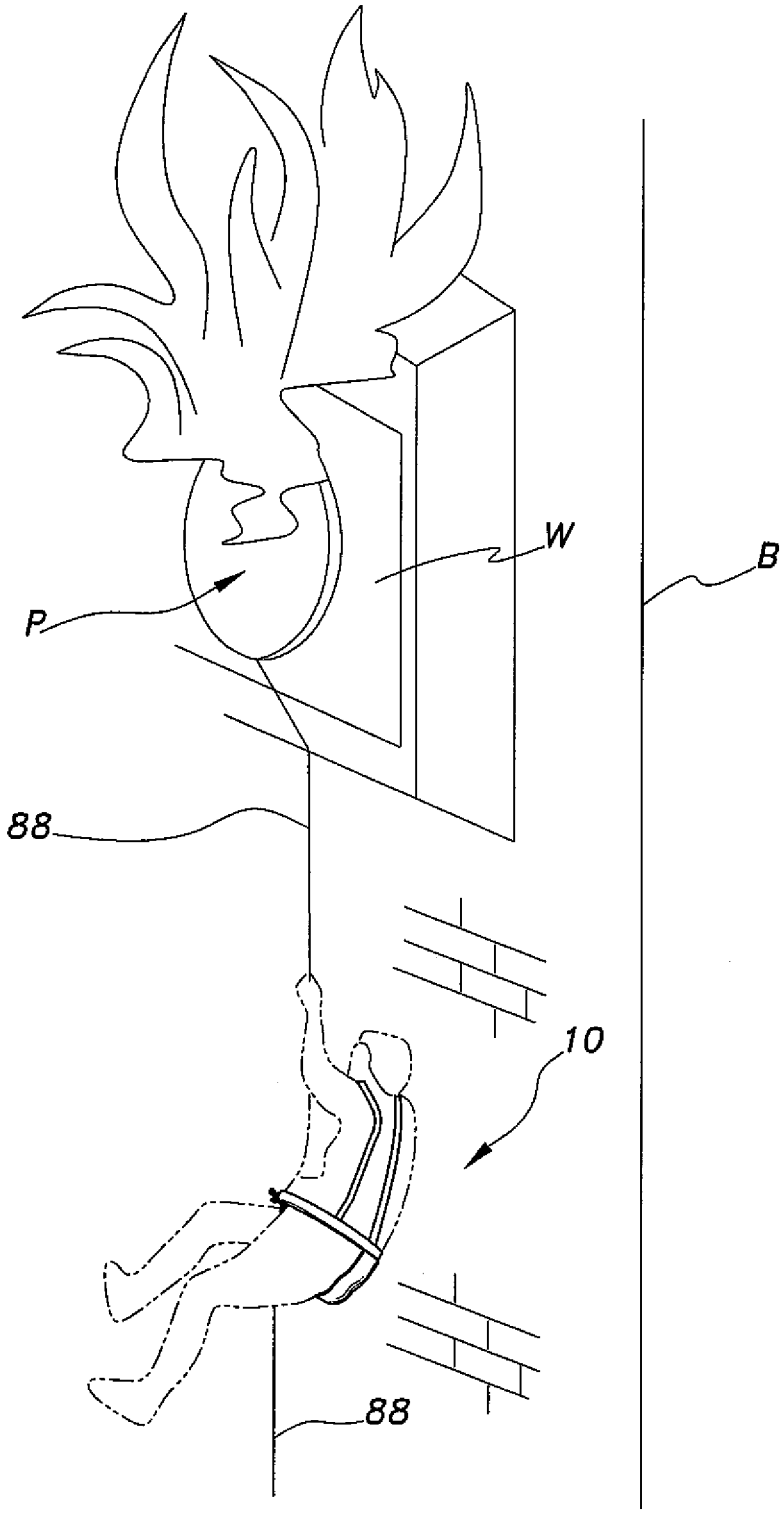
FIG. 1 is an environmental, perspective view of a rescue harness according to the present invention, showing its use and operation.

The rescue harness comprises a harness having a number of useful tools and equipment therewith, enabling a person to quickly don the harness and escape a high-rise structure or the like in the event of an emergency. FIG. 1 provides an environmental perspective view of a person using the rescue harness or harness 10 to escape a burning building structure B through an escape passage P formed through a glass window W.

Figure 2:
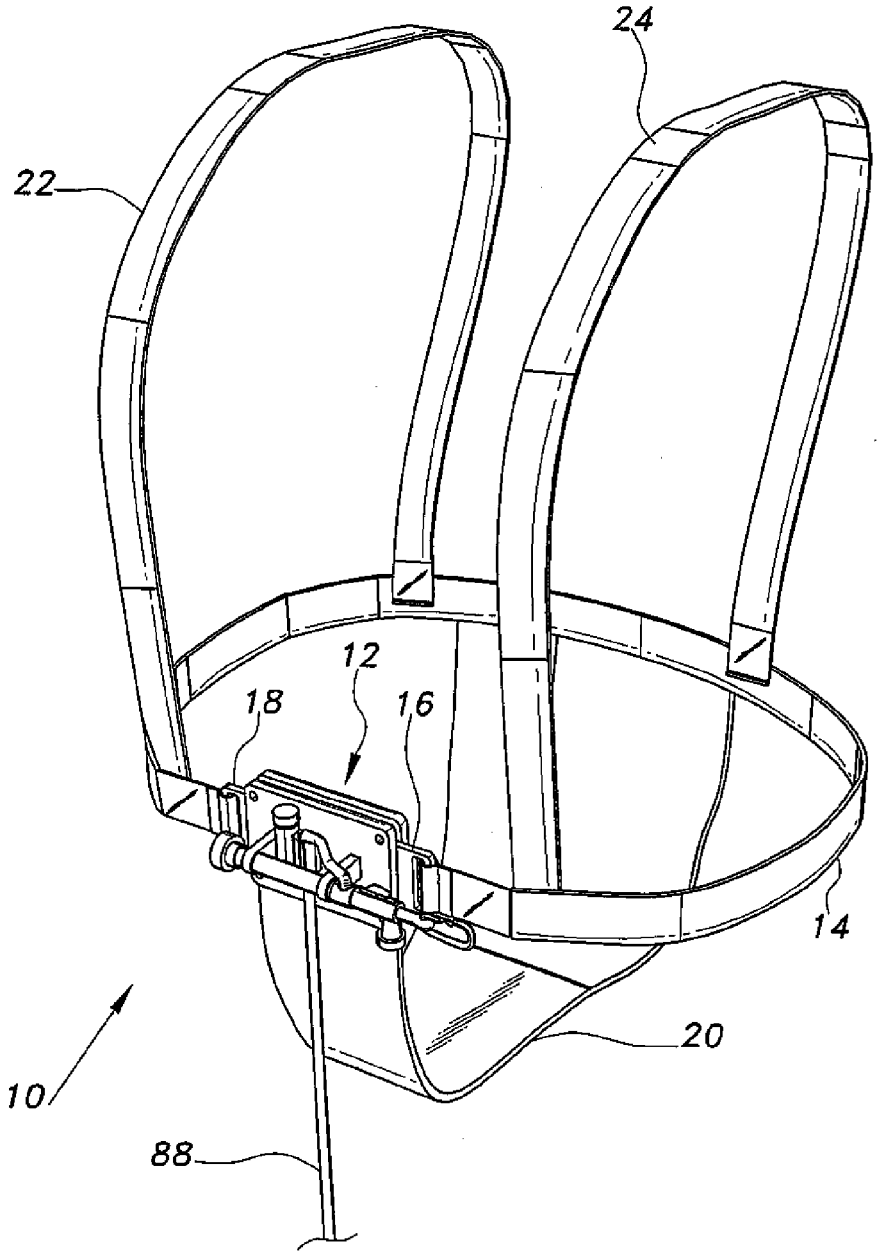
FIG. 2 is a front perspective view of the rescue harness according to the present invention, illustrating various features thereof.

FIG. 2 provides a perspective view of the rescue harness 10 and its latch and bracket assembly 12. The harness 10 includes an adjustable waist belt 14 having opposite first and second ends comprising latch tongues or tabs 16 and 18 that insert removably into the latch and bracket assembly 12. The waist belt connection to either or both end latch tabs 16 and/or 18 may include conventional length adjustment means (not shown for clarity in the drawings). A sling seat 20 extends from the back of the waist belt 14 to the lower portion of the latch and bracket assembly 12, and is adapted to pass beneath the crotch of a person wearing the harness 10. First and second shoulder straps, respectively 22 and 24, extend from the back to the front of the waist belt 14, and are adapted to pass over the shoulders of the person wearing the harness 10. The shoulder straps 22 and 24 may be elastic to preclude the need for mechanical adjustment of the length, thereby facilitating quick donning of the harness 10.

Figure 3:
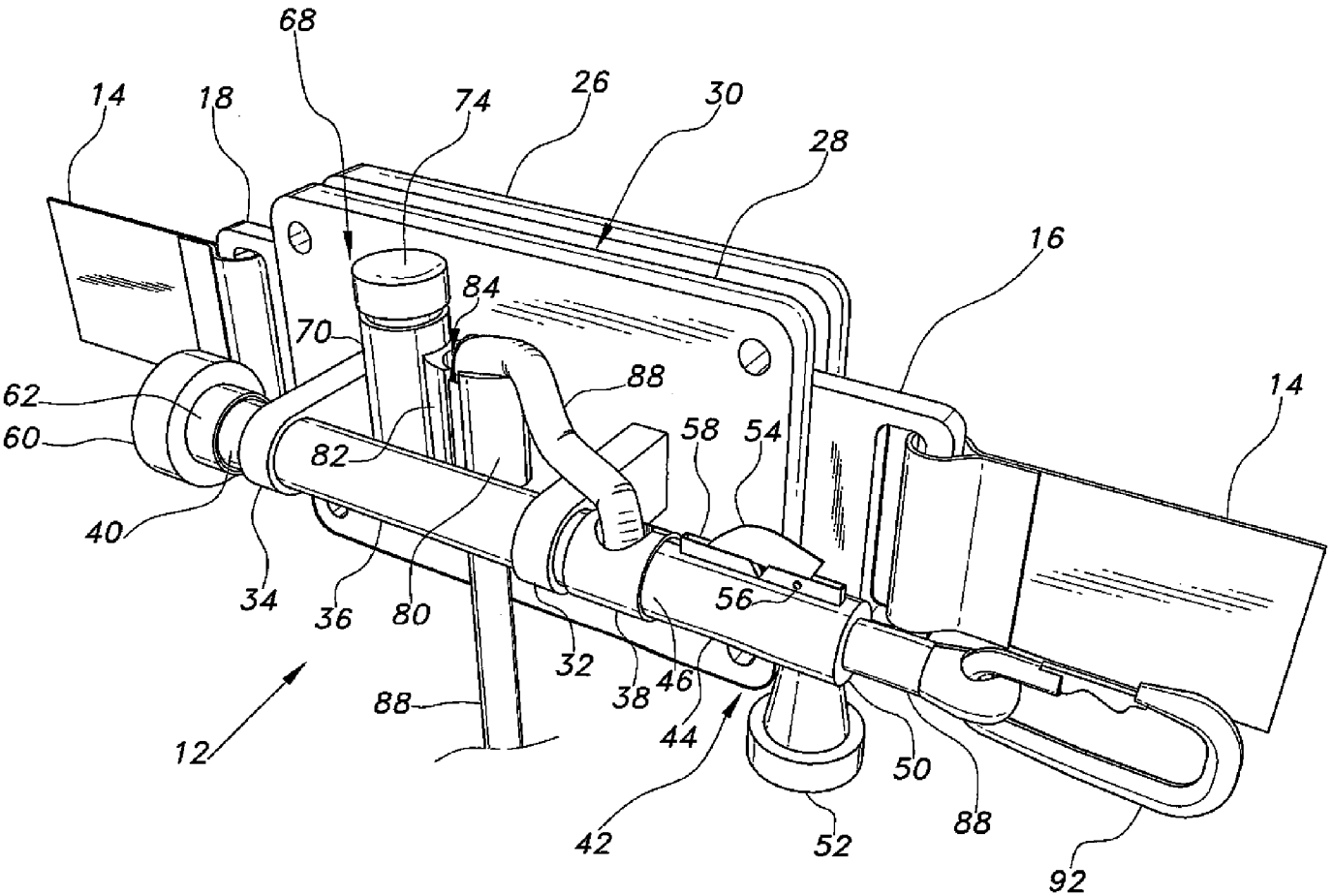
FIG. 3 is a detailed perspective view of the central latch and rope control components of the rescue harness according to the present invention, illustrating various details thereof.
Figure 4:
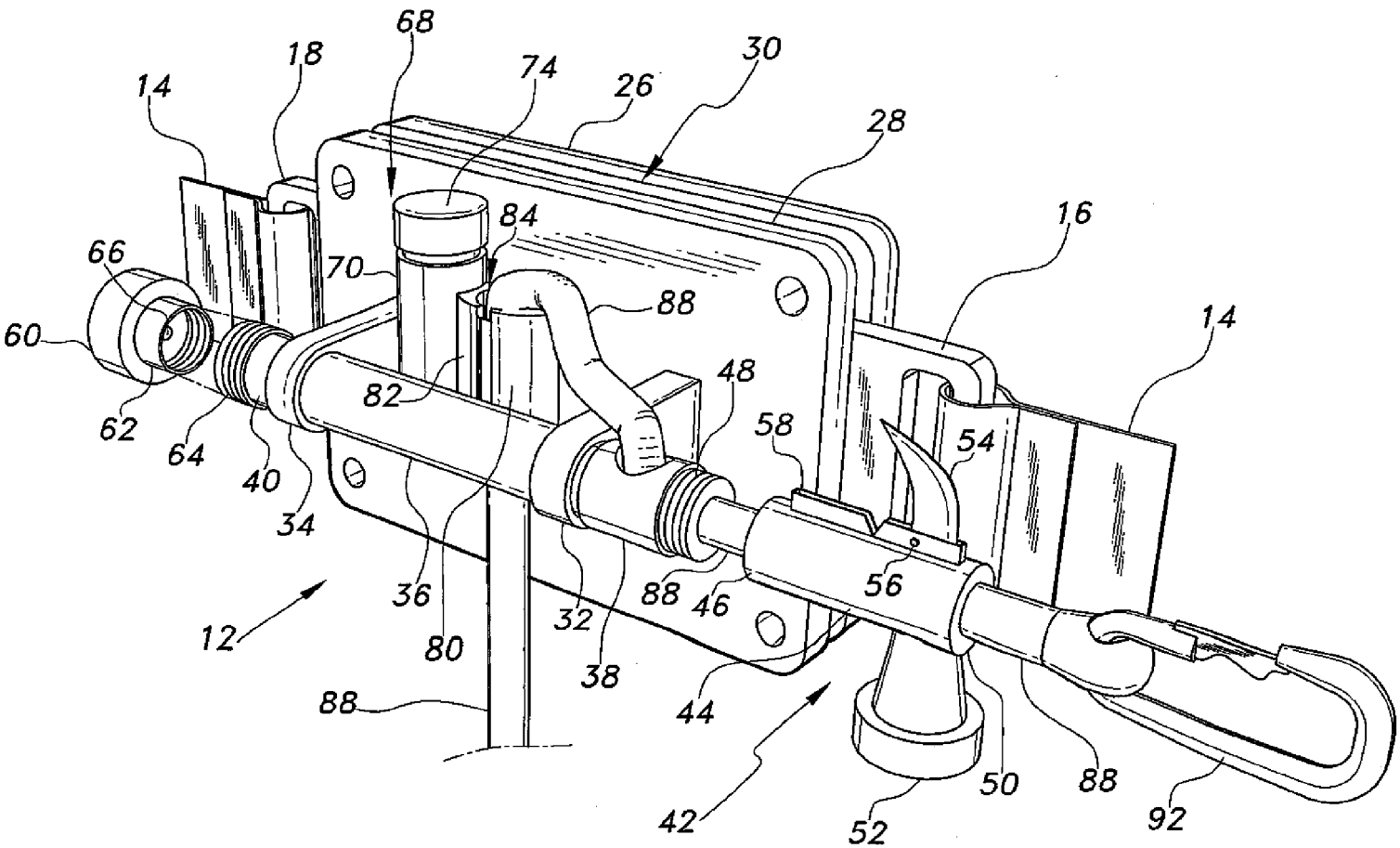
FIG. 4 is a detailed perspective view of the central latch and rope control components of the rescue harness according to the present invention, showing the deployment of various components therefrom.

FIGS. 3 and 4 provide detailed views of the latch and bracket assembly 12. The latch and bracket assembly 12 includes a rear plate 26 and a front plate 28 spaced apart from and parallel to the rear plate 26. The two plates 26 and 28 define a latch slot 30 therebetween for the removable insertion therein of the two latch tongues 16 and 18 of the belt 14. Laterally spaced first and second bosses or lugs 32 and 34 are affixed to the front plate 28, and extend forward therefrom. A bar 36 extends laterally between the two bosses 32 and 34. The bar 36 has a first end 38 affixed to the first boss 32 and extending laterally outward therefrom, and an opposite second end 40 affixed to the second boss 34 and extending laterally outward therefrom.

The bar 36 serves as an attachment for additional components of the rescue harness 10. A combination glass cutter and hammer assembly 42 extends removably from the first end 38 of the bar 36 beyond the first boss 32. The glass cutter and hammer assembly 42 comprises a heavy tubular sleeve 44 having an internally threaded attachment end 46 that threads removably onto the threaded portion 48 (FIG. 4) of the first end 38 of the bar 36, and an opposite distal end 50. A hammer head 52 extends from the side of the sleeve 44, and a glass cutting blade 54 retractably extends from the sleeve 44 opposite the hammer head 52. The glass cutting blade 54 is secured on a pivot pin 56 and folds or retracts downward into a guard 58 along the side of the sleeve 44 when not in use, as shown in FIG. 3. The blade 54 is shown extended for use in FIG. 4 of the drawings.

The opposite second end 40 of the bar 36 is equipped with a removable explosive charge 60 extending laterally therefrom beyond the second boss 34. The explosive charge 60 has an internally threaded attachment sleeve 62 that threads onto the externally threaded portion 64 (FIG. 4) of the second end 40 of the bar 36, in the manner of the attachment of the combination glass cutter and hammer assembly 42 to the first end 38 of the bar 36. The explosive charge 60 includes some conventional form of adhesive thereon, e.g., a contact adhesive protected by a release sheet, etc., to secure the charge 60 to a panel of glass for use. A conventional timer delay is also provided to enable the user to distance himself or herself from the immediate vicinity when the explosive charge 60 is set. The timer delay may be activated by a button 66 (FIG. 4) within the internally threaded attachment sleeve 62. The button 66 is protected from accidental activation when the explosive charge 60 is threaded onto the second end 40 of the bar 36.

Figure 5A:
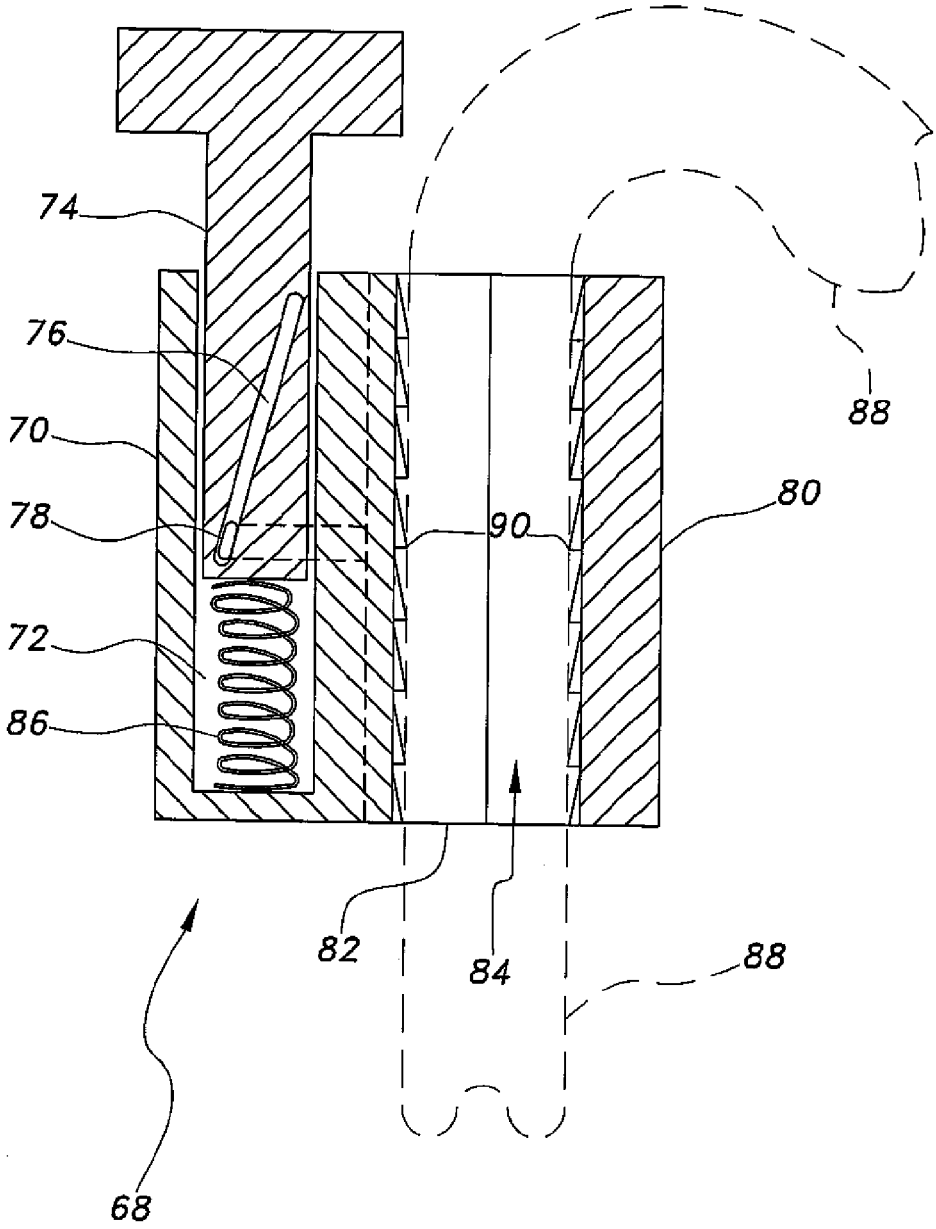
FIG. 5A is a detailed elevation view in section of the rope brake component of the rescue harness according to the present invention, showing the rope brake engaged.
Figure 5B:
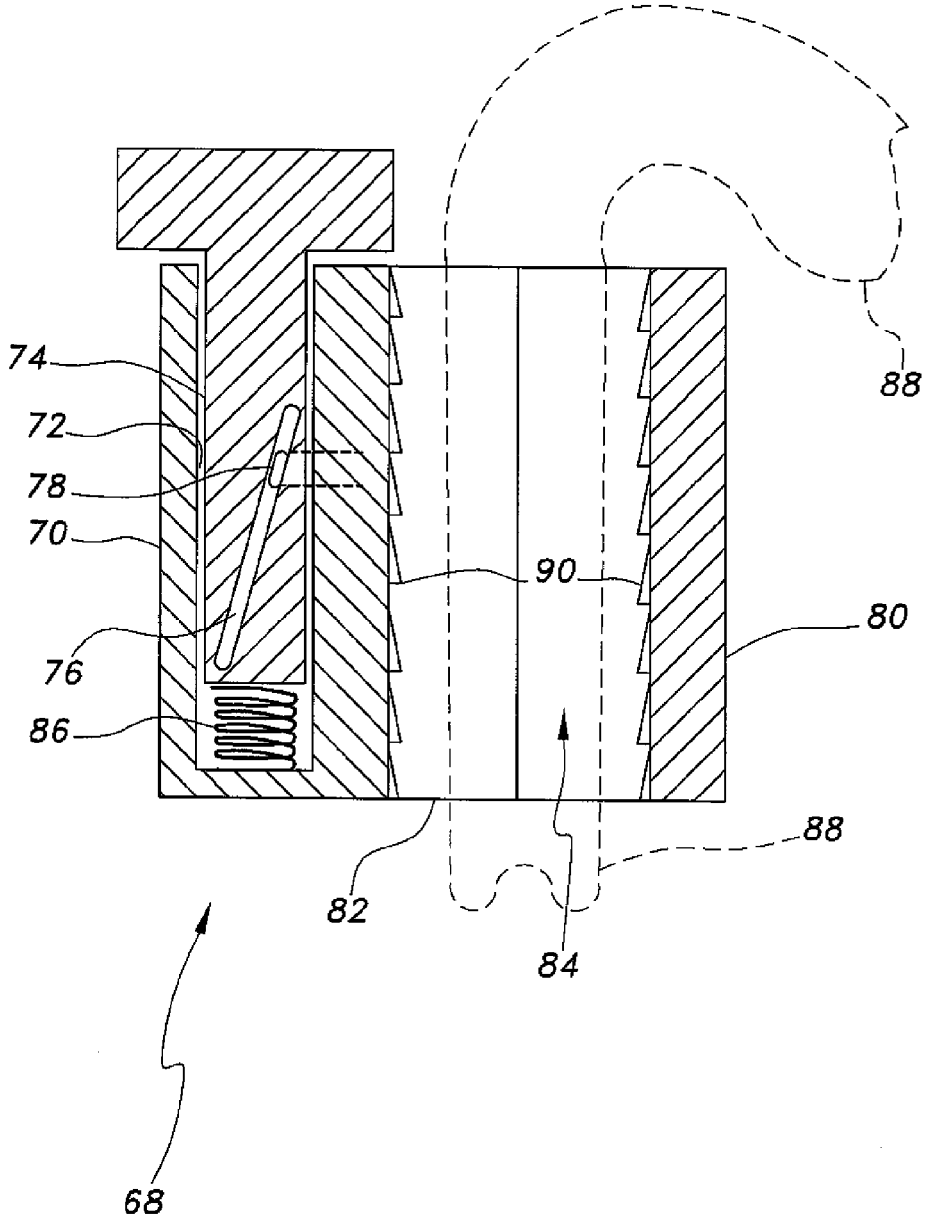
FIG. 5B is a detailed elevation view in section of the rope brake component of the rescue harness according to the present invention, showing the rope brake released.

A rope brake assembly 68 is affixed to the front plate 28 of the latch and bracket assembly 12 within the passage defined by the front plate 28, the first and second bosses 32 and 34, and the lateral bar 36. FIGS. 5A and 5B illustrate the structure and operation of the rope brake 68. The rope brake 68 includes a generally cylindrical first portion 70 having a pushbutton passage 72 disposed therein, and a pushbutton 74 (or more specifically, the shaft component of the pushbutton 74) slidably disposed within the pushbutton passage 72. The pushbutton 74 shaft has an oblique slot 76 disposed therein. The lower end of the slot 76 is angled away from a second portion 80 of the brake assembly, as described further below. The distal end of a lever arm 78 engages the slot 76 and extends laterally therefrom. The lever arm 78 is affixed to the second portion 80 of the rope brake assembly 68. The second portion 80 slidably extends laterally from the cylindrical first portion 70 and is secured thereto by the lever arm 78. The cylindrical first portion 70 of the rope brake device 68 has a lateral extension 82. The second portion 80 and the lateral extension 82 of the first portion 70 define a diametrically adjustable rope passage 84 therethrough. The rope passage 84 is substantially parallel to the pushbutton passage 72.

The rope passage 84 normally has a relatively narrow diameter or span, as shown in FIG. 5A. This is due to a compression spring 86 disposed in the bottom of the pushbutton passage 72, which urges the pushbutton 74 upward within the passage 72. This results in the distal end of the lever arm 78 riding in the lower end of the slot 76, and being drawn to the left side of the illustration in FIG. 5A. This draws the second portion 80 toward the first portion 70 of the brake assembly 68, thereby narrowing the span of the rope passage 84 to grip a rope 88 therein. Each side of the rope passage 84, i.e., the side defined by the lateral extension 82 of the first portion 70 and the opposite side defined by the laterally movable second portion 80 of the rope brake assembly 68, has a plurality of teeth 90 disposed to grip the rope 88 securely therein when the rope passage 84 is narrowed, as shown in FIG. 5A.

In FIG. 5B, the pushbutton 74 has been pushed downward in its passage 72 against the pressure of the spring 86. The oblique slot 76 also travels downward in the passage 72, and the lever arm 78 remains at the same height relative to the passage 72. This results in the lever arm 78 being pushed to the right (as seen in FIG. 5B) as it travels in the slot 76, or more precisely, as the slot 76 moves to deflect the lever arm 78 to the right. The second portion 80 of the rope brake assembly 68 moves to the right as well, since it is affixed to the lever arm 78 opposite the distal end thereof that rides in the slot 76. As the second portion 80 moves to the right, it widens the diameter or span of the rope passage 84, thus releasing the rope 88 to pass freely therethrough.

The rescue harness 10 provides self-rescue from a high-rise structure or the like in the event of an emergency, generally as shown in FIG. 1. If a life-threatening emergency occurs and the occupants of the structure are unable to escape via the elevators and/or stairways of the building, each occupant may don one of the rescue harnesses 10, as described further above. The rope 88 passes through the interior of the tubular sleeve 44 of the combination glass cutter and hammer device 42, as shown in FIGS. 3 and 4, and may be paid out by pressing the pushbutton 74 of the rope brake assembly 68, as described further above. The occupant then attaches the free end of the rope 88 to or around a secure object (e.g., interior column, the leg of a heavy desk, etc.) using the carabineer or clip 92 extending from the end of the rope.

The user of the harness 10 then unscrews the combination glass cutter and hammer assembly 42 from the first end 38 of the lateral bar 36, and extends the glass cutter blade 54 (as shown in FIG. 4) to scribe a circle or other closed shape on any suitable glass panel (window, etc.) for removal of the glass from that area. When the weakening scribe line has been formed, the user unscrews the explosive charge 60 from the opposite second end 40 of the lateral bar 36 and secures it to the area of glass to be removed using conventional adhesive attachment, as described further above. Once the explosive charge 60 has been set, the user activates the timer delay button 66 and removes himself or herself to a safe location before the explosive charge 60 detonates. The user may then use the hammer 52 to knock out any remaining shards of glass after the explosive charge 60 has blown out the weakened area of glass. The user then escapes through the opening in the glass window or panel and pays out the rope 88 at a reasonable rate by selectively pressing and releasing the pushbutton 74 of the brake release mechanism 68, generally as shown in FIG. 1 of the drawings.

It is to be understood that the present invention is not limited to the embodiments described above, but encompasses any and all embodiments within the scope of the following claims.

I claim:

1. A rescue harness, comprising:

a releasable waist belt having mutually opposed first and second ends;

a latch and bracket assembly, at least one of the ends of the waist belt being removably and adjustably secured to the latch and bracket assembly;

a combination glass cutter and hammer device removably attached to the latch and bracket assembly;

a rope brake disposed upon the latch and bracket assembly; and a rope disposed through the combination glass cutter and hammer device, the rope being adjustably disposed through the rope brake.

2. The safety harness according to claim 1, further comprising an explosive charge removably disposed upon the latch and bracket assembly.

3. The safety harness according to claim 2, further comprising a timer delay attachable to the explosive charge.

4. The safety harness according to claim 1, wherein the latch and bracket assembly comprises;

a rear plate;

a front plate spaced apart from and parallel to the rear plate, the rear plate and the front plate defining a latch slot therebetween;

laterally spaced first and second bosses extending forward from the front plate;

a bar extending laterally across the first and second bosses, the bar having mutually opposed first and second ends, the combination glass cutter and hammer device extending from the first end of the bar, the rope brake being disposed between the first and second bosses and between the front plate and the bar; and an explosive charge extending from the second end of the bar.

5. The safety harness according to claim 1, wherein the combination glass cutter and hammer device has a selectively retractable and extendible blade.

6. The safety harness according to claim 1, wherein the rope brake comprises:

a first portion having a pushbutton passage disposed therein;

a second portion extending from the first portion, the second portion being selectively slidable laterally, the first portion and the second portion defining a rope passage therethrough, the rope passage being substantially parallel to the pushbutton passage;

a pushbutton slidably disposed within the pushbutton passage, the pushbutton having an oblique slot disposed therein; and a lever arm extending from the second portion, the lever arm engaging the slot of the pushbutton;

wherein pressing the pushbutton extends the second portion away from the first portion, thereby widening the rope passage and releasing the rope therethrough.

7. The safety harness according to claim 1, further comprising:

a sling seat depending from the waist belt; and first and second elastic shoulder straps extending from the waist belt.

8. A rescue harness, comprising:

a releasable waist belt having mutually opposed first and second ends;

a latch and bracket assembly, at least one of the ends of the waist belt being removably and adjustably secured to the latch and bracket assembly;

a rope brake disposed upon the latch and bracket assembly;

a rope adjustably disposed through the rope brake; and an explosive charge removably and directly attached to the latch and bracket assembly.

9. The safety harness according to claim 8, further comprising a combination glass cutter and hammer device removably attached to the latch and bracket assembly.

10. The safety harness according to claim 9, wherein the combination glass cutter and hammer device has a selectively retractable and extendible blade.

11. The safety harness according to claim 8, wherein the latch and bracket assembly comprises;

a rear plate;

a front plate spaced apart from and parallel to the rear plate, the rear plate and the front plate defining a latch slot therebetween;

laterally spaced first and second bosses extending forwardly from the front plate; and a bar extending laterally across the first and second bosses, the bar having mutually opposed first and second ends, a first tool extending from the first end of the bar, the rope brake being disposed between the first and second bosses and between the front plate and the bar, the explosive charge extending from the second end of the bar.

12. The safety harness according to claim 8, further comprising a timer delay attachable to the explosive charge.

13. The safety harness according to claim 8, wherein the rope brake comprises:

a first portion having a pushbutton passage disposed therein;

a second portion extending from the first portion, the second portion being selectively slidable laterally, the first portion and the second portion defining a rope passage therethrough, the rope passage being substantially parallel to the pushbutton passage;

a pushbutton slidably disposed within the pushbutton passage, the pushbutton having an oblique slot disposed therein; and a lever arm extending from the second portion, the lever arm engaging the slot of the pushbutton;

wherein pressing the pushbutton extends the second portion away from the first portion, thereby widening the rope passage and releasing the rope therethrough.

14. The safety harness according to claim 8, further comprising:

a sling seat depending from the waist belt; and first and second elastic shoulder straps extending from the waist belt.

15. A rescue harness, comprising:

a releasable waist belt having mutually opposed first and second ends;

a sling seat depending from the waist belt;

first and second elastic shoulder straps extending from the waist belt;

a latch and bracket assembly, at least one of the ends of the waist belt being removably and adjustably secured to the latch and bracket assembly, the latch and bracket assembly having;

a rear plate;

a front plate spaced apart from and parallel to the rear plate, the rear plate and the front plate defining a latch slot therebetween;

laterally spaced first and second bosses extending forwardly from the front plate;

a bar extending laterally across the first and second bosses, the bar having mutually opposed first and second ends;

a first tool extending from the first end of the bar;

an explosive charge extending from the second end of the bar;

a rope brake disposed between the first and second bosses, and between the front plate and the bar; and a rope adjustably disposed through the rope brake.

16. The safety harness according to claim 15, wherein the first tool comprises a combination glass cutter and hammer device.

17. The safety harness according to claim 16, wherein the combination glass cutter and hammer device has a selectively retractable and extendible blade.

18. The safety harness according to claim 15, further comprising a timer delay attachable to the explosive charge.

19. The safety harness according to claim 15, wherein the rope brake comprises:

a first portion having a pushbutton passage disposed therein;

a second portion extending from the first portion, the second portion being selectively slidable laterally, the first portion and the second portion defining a rope passage therethrough, the rope passage being substantially parallel to the pushbutton passage;

a pushbutton slidably disposed within the pushbutton passage, the pushbutton having an oblique slot disposed therein; and a lever arm extending from the second portion, the lever arm engaging the slot of the pushbutton;

wherein pressing the pushbutton extends the second portion away from the first portion, thereby widening the rope passage and releasing the rope therethrough.

* * * * *